US006252575B1

(12) United States Patent
Kern

(10) Patent No.: US 6,252,575 B1
(45) Date of Patent: Jun. 26, 2001

(54) METHOD OF SELECTIVELY CHANGING AN IMAGE ON A SIGN AND A SIGN WITH SELECTIVELY CHANGEABLE IMAGE DISPLAY

(76) Inventor: Trevor Jason Kern, 1113 Henson Close, Edmonton, Alberta (CA), T6R 2M2

( * ) Notice: Subject to any disclaimer, the term of this patent is extended or adjusted under 35 U.S.C. 154(b) by 0 days.

(21) Appl. No.: 09/245,173

(22) Filed: Feb. 5, 1999

(51) Int. Cl.[7] ..... G09G 3/34

(52) U.S. Cl. ..... 345/108; 40/471; 340/815.83

(58) Field of Search ..... 345/108, 110; 40/471, 624, 124.02; 340/815.83

(56) References Cited

U.S. PATENT DOCUMENTS 5,100,330 * 3/1992 Sekiguchi ..... 434/426
5,672,381 * 9/1997 Rajan ..... 427/198

* cited by examiner

*Primary Examiner*—Bipin Shalwala
*Assistant Examiner*—Ricardo Osorio
(74) *Attorney, Agent, or Firm*—Christensen O'Connor Johnson Kindness PLLC

(57) ABSTRACT

A method of selectively changing an image on a sign and a sign with selectively changeable image display. A body is provided having a viewing aperture, a printer, and a printed media support for tensioning and advancing printed media produced by the printer across the viewing aperture. The printer is connected to a computer and print files downloaded from the computer to initiate printing by the printer onto printed media and advancing printed media across the viewing aperture.

9 Claims, 6 Drawing Sheets

METHOD OF SELECTIVELY CHANGING AN IMAGE ON A SIGN AND A SIGN WITH SELECTIVELY CHANGEABLE IMAGE DISPLAY

FIELD OF THE INVENTION

The present invention relates to method of selectively changing an image on a sign and a sign with selectively changeable image display.

BACKGROUND OF THE INVENTION

Signage is used to convey information about products, services, or events to members of the public. Signage presently in use is printed at a remote location. It is then shipped to a point of display and installed at that point manually. The costs associated with printing, transportation, and installation are high. Advance planning is essential, as significant lead time is required to produce, ship and install the signage.

Between 20% and 30% of the signage produced is never installed due directly or indirectly to human error. If care is not taken, an error can occur during printing that renders the signage unsuitable for use. If the signage is not securely packed, damage can occur during shipping that renders the signage unsuitable for use. If appropriate care is not taken, damage to the signage can occur during installation. If delays occur in shipping or if staff do not proceed promptly with installation, there is no point installing signage after it's intended date of use has passed. Appropriately trained staff are required at every stage in the process in order to reduce the likelihood of human errors occurring.

It had been thought that the answer to these problems would lie in electronic signage. However, there is a dramatic increase in cost as the size of the electronic signage increases, this makes cost of such technology prohibitive for many applications. In addition, electronic sign technology remains subject to technical problems. Electronic displays capable of high resolution suffer from low brightness, making them only marginally useful for high ambient light applications. The displays are also subject to reflections off the display surfaces, limited viewing angles and poor overall contrast. The consumption of power by electronic signage is high. Reliability and life span remain as problems with some types of electronic signs. Until the electronic display technology matures, alternative technologies will have to be used to provide a selectively changeable image display.

SUMMARY OF THE INVENTION

What is required is a method of selectively changing an image on a sign and a sign with selectively changeable image display in accordance with the teachings of the method.

According to one aspect of the present invention there is provided a method of selectively changing an image on a sign. A body is provided having at least one viewing aperture, a printer, and a printed media support for tensioning and advancing printed media produced by the printer across the at least one viewing aperture. The printer is connected to a computer and print files downloaded from the computer to initiate printing by the printer onto printed media.

With the method, as described above, the sign has its own printer which is capable of printing text messages, graphic messages, or a combination of both. The message displayed can be changed at will, by hooking up a computer to the sign and downloading a new print file to the printer. The sign need not have its own computer, as service personnel can take with them a portable computer that contains the print files. This method has a number of inherent advantages. There is no need for lead time, the sign can be changed contemporaneously as events occur. There is no need to out source the manufacturing of the sign. The printer can print out any message or graphic prepared on a desk top computer. The sign does not have to be manufactured in quantity to be of reasonable cost. Each sign can be customized to suit its location. The signage does not have to be delivered or installed. When the signage has served its purpose, it does not have to be removed.

Although beneficial results may be obtained through the use of the method, as described above, it is preferred that each sign have its own computer. When the sign does not have its own computer, trained personnel are required to go around with computers to change the message on the sign. When the sign has its own computer, however, a computer disk can be sent through the mail and can be entered into the computer by unskilled personnel on site. A further step can be taken to reduce the frequency of intervention by unskilled personnel on site by having the computer preprogrammed to initiate periodic downloading of stored print files to the printer.

Although beneficial results may be obtained through the use of the method, as described above, it is preferred that each sign have a communications module connected to the computer. Even more beneficial results may, thereby, be obtained as the communications module gives the computer the capability of receiving signals from a remote source to receive new print files as data and then initiate downloading such data as print files to the printer. This eliminates the need for the intervention of on site personnel to periodically enter into the computer a new sequence of print files on disk. This eliminates the possibility of human error at the point of display. It eliminates most of the labour previously associated with signage. The process can be controlled from one remote location, with the equipment serviced periodically to ensure there is an adequate supply of consumable, such as printer paper and printer ink.

Although beneficial results may be obtained through the use of the method, as described above, even more beneficial results may be obtained when the communications module is capable of two way communications to the computer so that service personnel can be alerted when service is required to the printer or printed media support. With this feature servicing would only be required upon the sign signalling a immediate problem, such as a paper jam, or signalling an advance warning that consumable such as printer paper or printer ink were in short supply.

According to another aspect of the present invention there is provided a sign with a selectively changeable image display including a body having at least one viewing aperture, a printer, and a printed media support for tensioning and advancing printed media produced by the printer across the at least one viewing aperture. A coupling is provided for connecting the printer to a computer, whereby print files are downloaded from the computer to initiate printing by the printer onto printed media.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
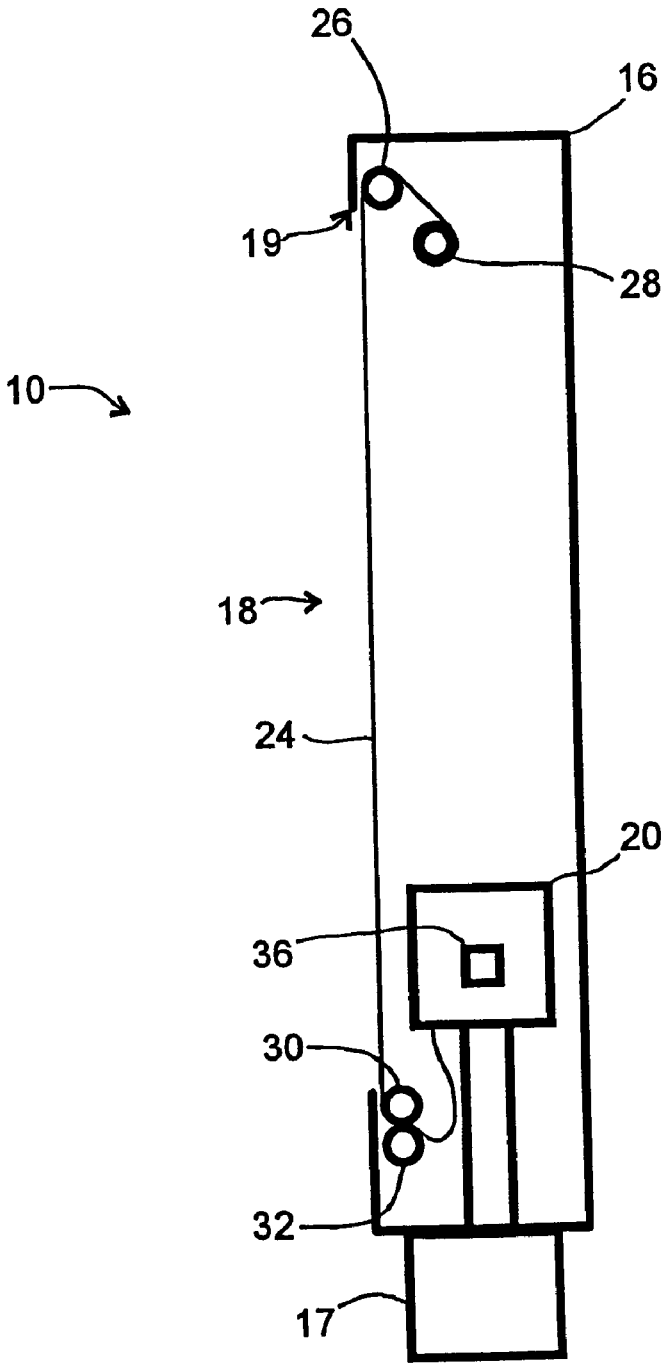
FIG. 1 is a side elevation view, in section, of a first embodiment of sign with selectively changeable image display constructed in accordance with the teachings of the present invention.

A sign with selectively changeable image display will now be described with reference to FIGS. 1 through 6. A first embodiment, generally identified by reference numeral 10, will be described with reference to FIGS. 1 through 3. A second embodiment, generally identified by reference numeral 12, will be described with reference to FIGS. 4 and 5. A third embodiment, generally identified by reference numeral 17, will be described with reference to FIG. 6.

Figure 2:
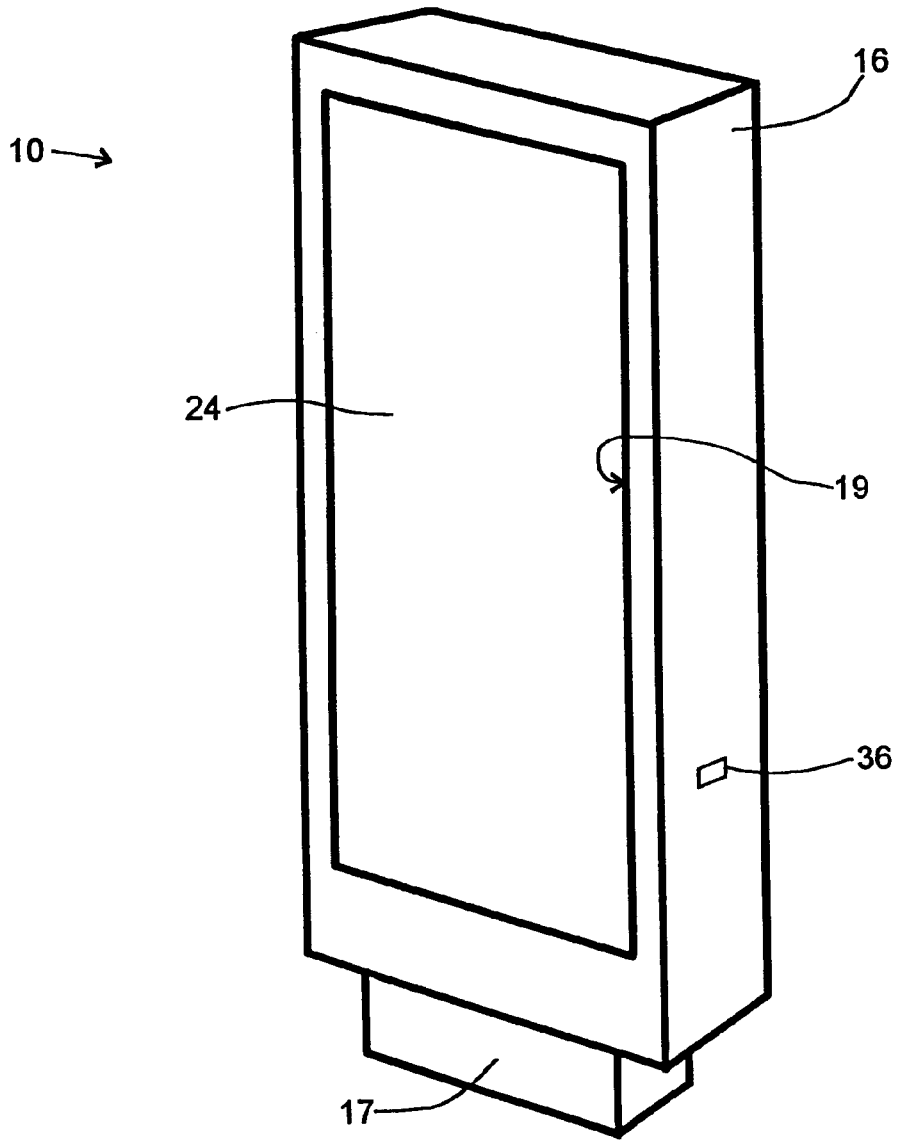
FIG. 2 is a perspective view of the sign illustrated in FIG. 1.

Referring to FIGS. 1 and 2, sign 10 includes a housing 16 having a viewing aperture 18 defined by a peripheral boundary 19. Sign 10 is supported on a base 17. Referring to FIG. 1, a programmable printer 20 is housed within housing 16. A printed media support is provided for tensioning and advancing a printed media 24 produced by printer 20 across viewing aperture 18. Printed media support is housed within housing 16 and includes a tensioning roller 26, a take-up roller 28, an upper feed roller 30 and a lower feed roller 32 between which printed media 24 is fed under tension from tensioning roller 26. Take up roller 28, tensioning roller 26, upper feed roller 30 and lower feed roller 32 are driven by a motor (not shown). Referring to FIGS. 1 and 2, a port 36 is provided whereby print files are downloaded from a portable computer or other remote data source (not shown) into printer 20 to initiate printing by printer 20 onto printed media 28.

The use and operation of sign 10 will now be described with reference to FIGS. 1 and 2. Referring to FIG. 1, sign 10 has its own printer 20 which is capable of printing text messages, graphic messages, or a combination of both. Printer 20 is connected to a portable computer (not shown) and a print file is downloaded from said portable computer to initiate printing by printer 20 onto printed media 24. The message displayed can be changed at will, by downloading a new print file to printer 20. When printed with text or graphics for display printed media 24 is advanced to a position such that said text and graphics are viewed through aperture 18, as illustrated in FIGS. 1 and 2.

Figure 3:
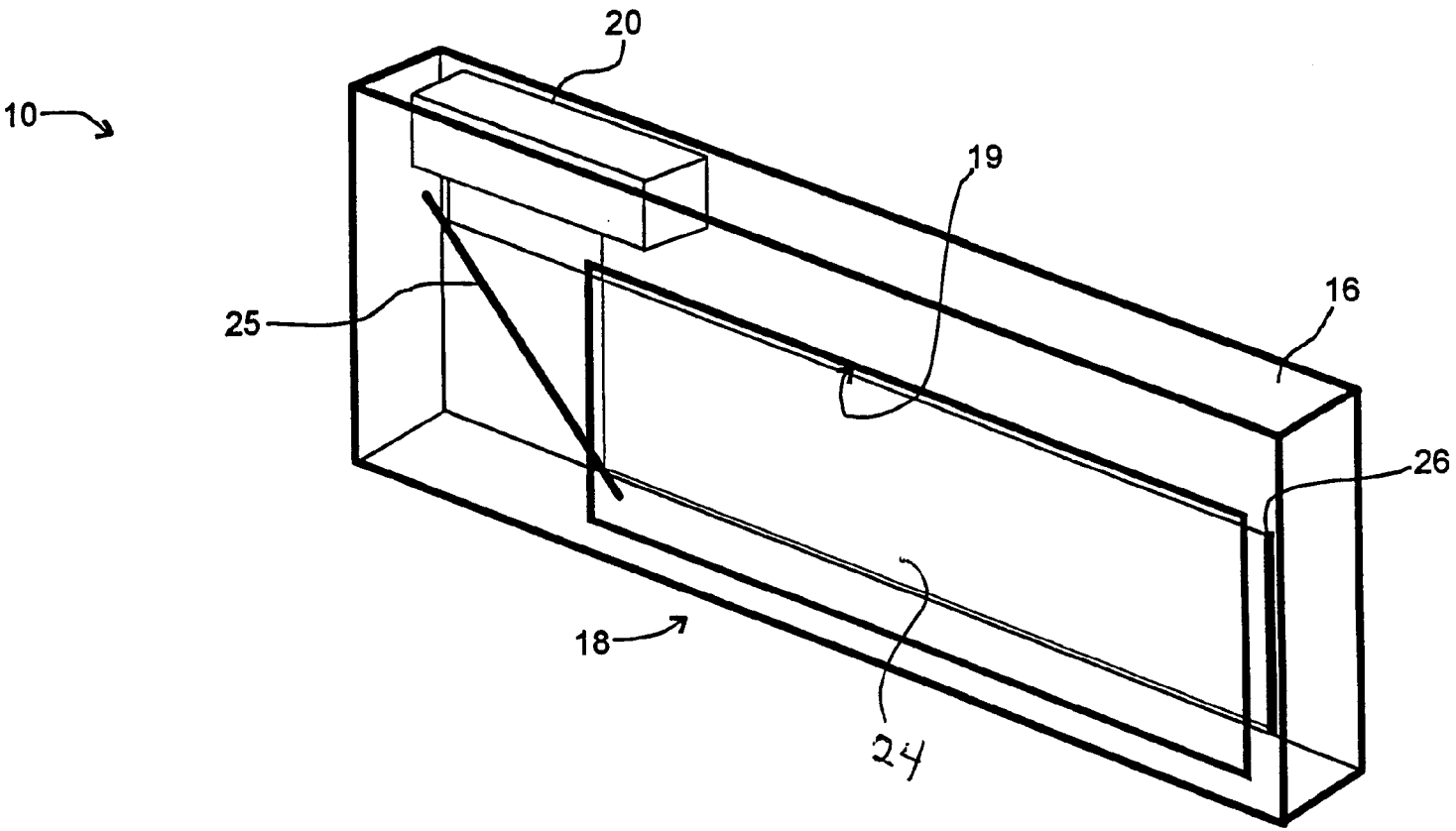
FIG. 3 is a cut away perspective view of a horizontal configuration of the sign illustrated in FIG. 1.

Referring to FIG. 3, first embodiment of sign 10 is illustrated in a horizontal, as opposed to a vertical orientation. This sign contains the same components and operates, as described in relation to sign 10. There is one difference that should be noted. Printed media does not come off programmable printer 20 in a horizontal orientation. A transition roller 25 must, therefore, be positioned on an angle to redirect printed media 24 from printer 20 across viewing aperture 18.

Figure 4:
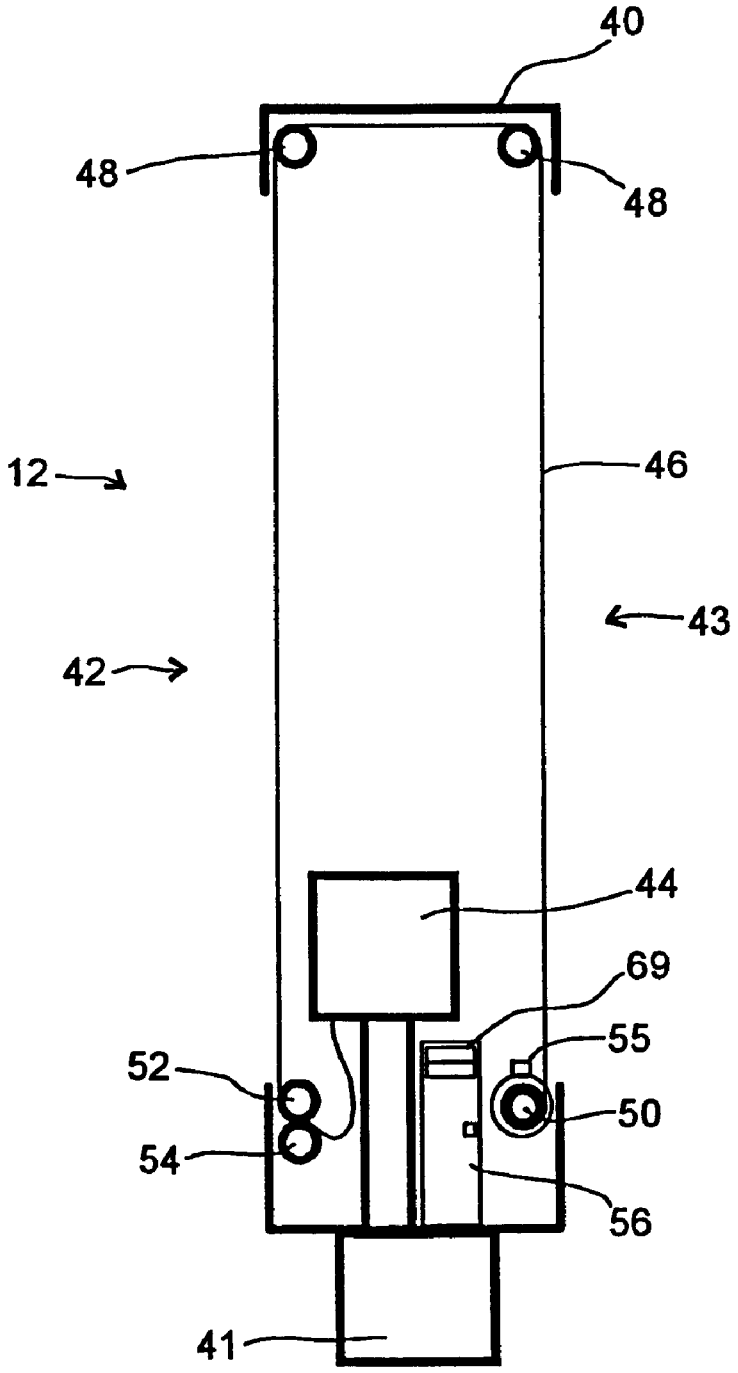
FIG. 4 is a side elevation view, in section, of a second embodiment of sign with two viewing apertures on opposite sides of sign and selectively changeable image display constructed in accordance with the teachings of the present invention.
Figure 5:
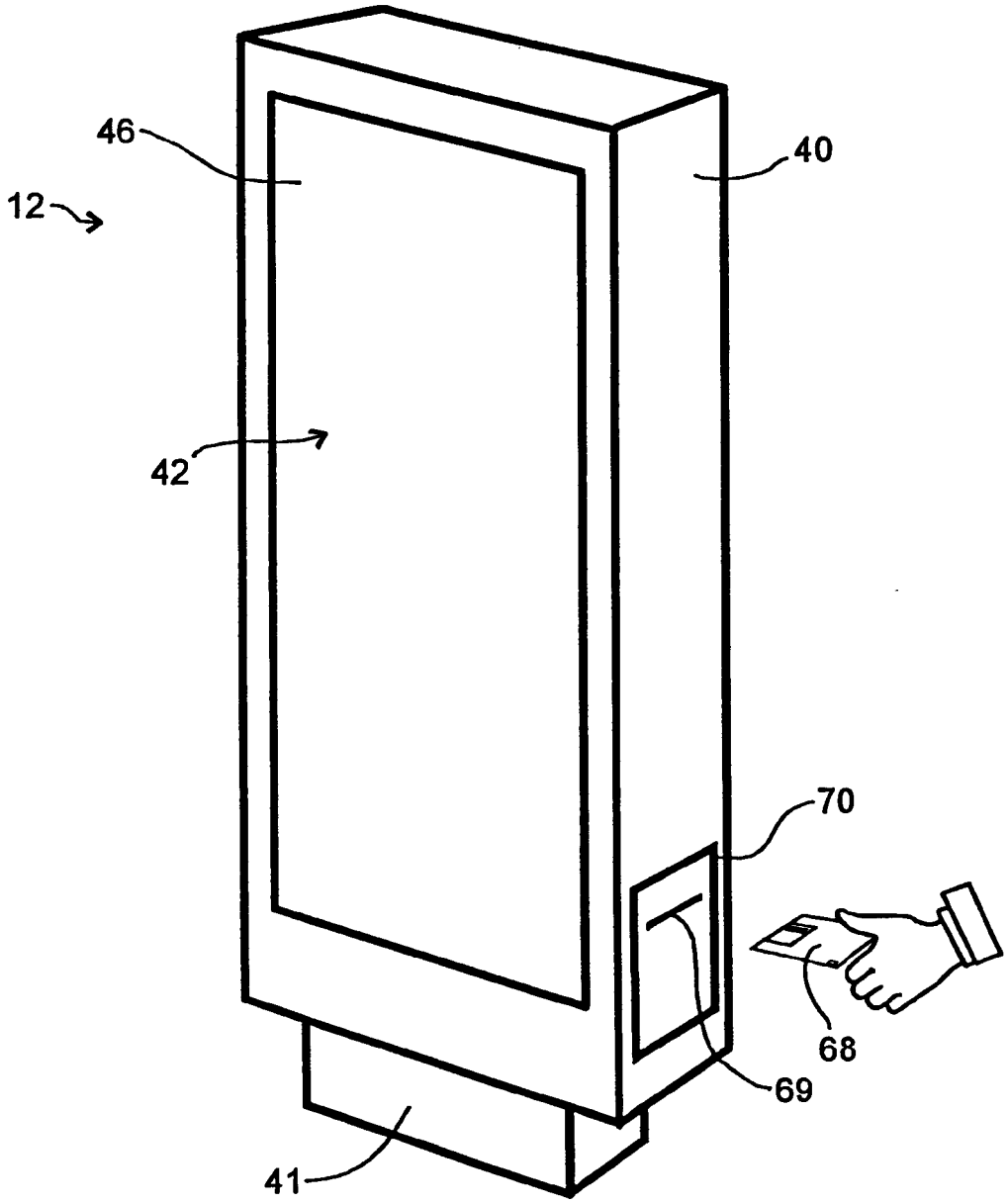
FIG. 5 is a perspective view of the second embodiment of sign with selectively changeable image display illustrated in FIG. 4.

Referring to FIG. 4, sign 12 shows enhancements that can be added to sign 10. Sign 12 has a housing 40 having a pair of viewing apertures 42, 43 on each of two opposed sides. Housing 40 is supported on a base 41. A printer 44 is housed within housing 40. A printed media support is provided for tensioning and advancing a printed media 46 produced by printer 44 across viewing apertures 42 and 43. Printed media support is housed within housing 40 and includes a plurality of upper tensioning rollers 48, a take-up roller 50, an upper feed roller 52 and a lower feed roller 54, which are driven by a motor 55. A computer 56 is provided within housing 40 coupled with printer 44 and motor 55. Computer 56 is preprogrammed to provide print commands to printer 44 and control the advance and tensioning of printed media 46 through motor 55. Referring to FIG. 5, a port 70 is provided whereby print files and command files with print sequence timetables can be downloaded from a computer disk 68 to disk drive 69 of computer 56.

The use and operation of sign 12 will now be described with reference to FIGS. 4 and 5. Referring to FIG. 5, computer 56 receives updated information by inserting a computer disk 68 into disk drive 69. Computer 56 has stored in memory a sequence of print files along with a timetable for changing from one print file to another. Referring to FIG. 4, in accordance with the print timetable and sequence, computer 56 downloads a print file and print command to printer 40 to initiate printing by printer 40 onto printed media 46. Computer 56 controls the operation of motor 55 to advance printed media 46 to ensure that text and graphics are visible through apertures 42 and 43. If desired, sign 12 can be configured horizontally, as described and illustrated in relation to FIG. 3.

Figure 6:
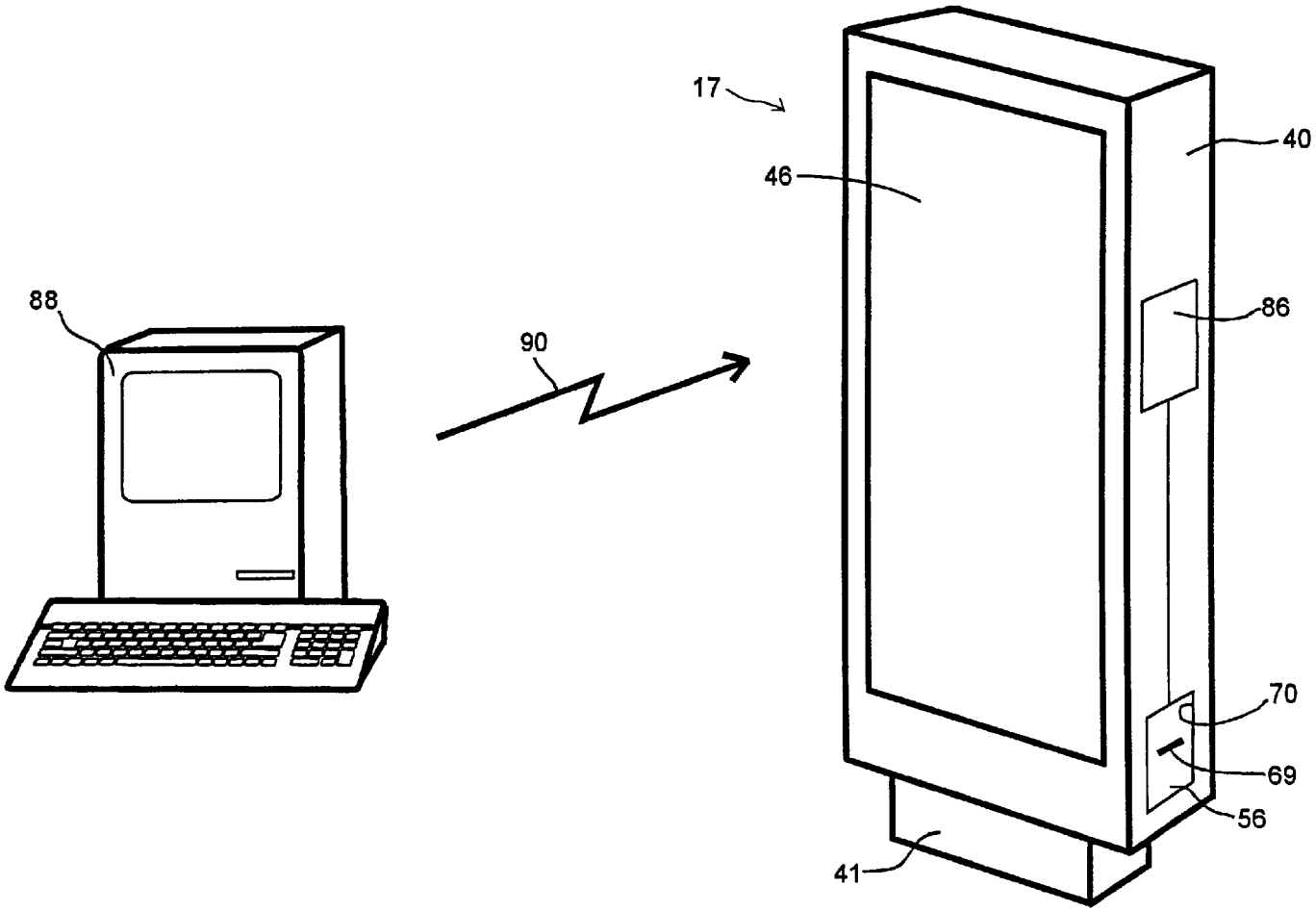
FIG. 6 is a perspective view of a third embodiment of sign with selectively changeable image display constructed in accordance with the teachings of the present invention.

Referring to FIG. 6, sign 17 is intended to illustrate how sign 12 can be adapted for use with a remote signal from a remote terminal. Sign 17 includes all of the same components as sign 12. However, in addition to port 70 providing access to disk drive 69, housing 40 is provided with a communications module 86. Communications module 86 is connected to computer 56 and enables computer 56 to receive data from a remote processing unit 88 by a signal 90. This signal 90 could be a radio signal, a signal over telephone lines, or another form of remote communication linkage. Preferably, communications module 86 is capable of two way communications, enabling computer 56 to alert service personnel when service is required to the printer or other operating components. The use and operation of sign 17 is substantially the same as for sign 12, except that computer 56 can have its program and print files updated remotely from remote processing unit 88 through communications module 86.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of selectively changing an image on a sign, comprising the steps of:

providing a body having at least one viewing aperture, a printer, and a printed media support for tensioning and advancing printed media produced by the printer across the at least one viewing aperture; and connecting the printer to a computer and downloading print files from the computer to initiate printing by the printer onto printed media.

2. The method of selectively changing an image on a sign as defined in claim 1, having the computer positioned one of within or adjacent to the body.

3. A sign with a selectively changeable image display, comprising:

a body having at least one viewing aperture;

a printer;

a printed media support for tensioning and advancing printed media produced by the printer across the at least one viewing aperture; and a coupling for connecting the printer to a computer, whereby print files are downloaded from the computer to initiate printing by the printer onto printed media.

4. The sign with a selectively changeable image display as defined in claim 3, wherein the printer is housed within the body.

5. The sign with a selectively changeable image display as defined in claim 3, wherein the computer is housed within the body.

6. The sign with a selectively changeable image display as defined in claim 3, wherein the printed media support includes a tensioning roller and a take-up roller.

7. The sign with a selectively changeable image display as defined in claim 6, wherein the printed media support is computer controlled.

8. The sign with a selectively changeable image display as defined in claim 3, wherein there are two or more viewing apertures.

9. The sign with a selectively changeable image display as defined in claim 8, wherein there are two viewing apertures, one on each of two opposed sides of the body.

* * * * *